US007424799B2

(12) United States Patent
Badiali et al.

(10) Patent No.: US 7,424,799 B2
(45) Date of Patent: Sep. 16, 2008

(54) POSITIONING DEVICE OF THE THREAD SKEIN-END OF THE THREAD FOR SERVICE TROLLEYS FOR OPEN-END SPINNING MACHINES

(75) Inventors: Roberto Badiali, Pordenone (IT); Vittorio Colussi, Cappella Maggiore (IT); Donato Castellarin, Azzano Decimo (IT)

(73) Assignee: Savio Machines Tessili S.p.A., Pordenone (IT)

( * ) Notice: Subject to any disclaimer, the term of this patent is extended or adjusted under 35 U.S.C. 154(b) by 7 days.

(21) Appl. No.: 11/646,040

(22) Filed: Dec. 27, 2006

(65) Prior Publication Data

US 2007/0175199 A1 Aug. 2, 2007

(30) Foreign Application Priority Data

Jan. 4, 2006 (IT) ..... MI2006A0008

(51) Int. Cl.
*B65G 69/06* (2006.01)

(52) U.S. Cl. ..... 57/22; 57/263

(58) Field of Classification Search ..... 57/22, 57/261, 263, 269, 281; 242/473.7, 475.8, 242/475.7

See application file for complete search history.

(56) References Cited

U.S. PATENT DOCUMENTS

| | | | | |
|---|---|---|---|---|
| 3,248,063 | A * | 4/1966 | Sheldon et al. | 242/481.8 |
| 4,438,624 | A * | 3/1984 | Mayer et al. | 57/352 |
| 5,193,332 | A * | 3/1993 | Kriegler et al. | 57/263 |
| 5,285,975 | A * | 2/1994 | Mayer et al. | 242/615.3 |
| 5,393,002 | A * | 2/1995 | Greis et al. | 242/475.8 |
| 2005/0082415 | A1 * | 4/2005 | Badiali et al. | 242/473.6 |

FOREIGN PATENT DOCUMENTS

EP 1524230 A2 * 4/2005

* cited by examiner

*Primary Examiner*—Shaun R Hurley
(74) *Attorney, Agent, or Firm*—James V. Costigan; Hedman & Costigan, P.C.

(57) ABSTRACT

Service trolley for open-end spinning machines equipped for the depositing of the final thread reserve on the exhausted bobbin comprising a thread-guide with a horizontal worm-screw, equipped with a cantilever supporting arm which allows its positioning at different levels and also its axial movement, activated in controlled clockwise/anticlockwise rotation driven by a motor, thus determining both the level and axial coordinate to which the thread is brought and wound onto the tube.

7 Claims, 8 Drawing Sheets

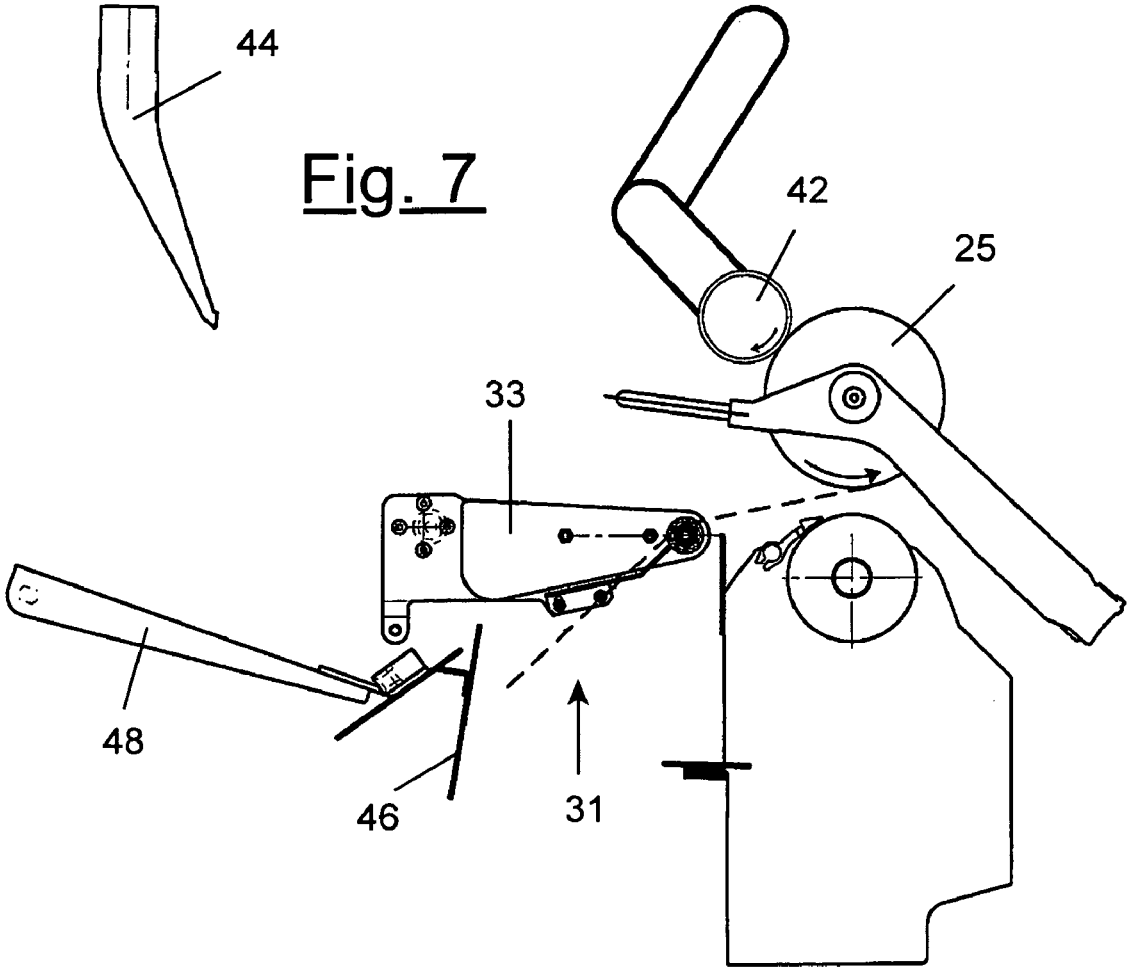
Fig. 7
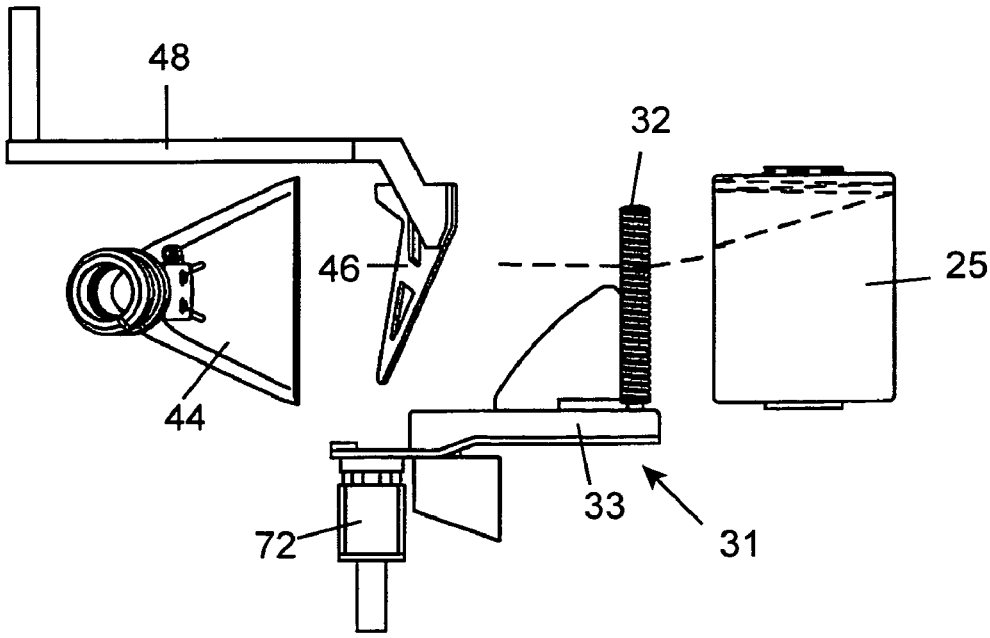

POSITIONING DEVICE OF THE THREAD SKEIN-END OF THE THREAD FOR SERVICE TROLLEYS FOR OPEN-END SPINNING MACHINES

BACKGROUND OF THE INVENTION

The present invention relates to open-end spinning or rotor spinning. Open-end spinning machines generally consist of a series of individual spinning units, aligned on the two fronts of the machine, each of which consists of a spinning rotor, which produces twisted thread starting from the singularized fibres of a sliver, and a collection unit which—after controlling the quality of the yarn with the interpositioning of a slubcatcher between the two components—causes the yarn to be wound onto a tube to form a bobbin. This bobbin is thus formed by pulling and winding the yarn onto its surface, as it is pulled in rotation by the underlying roll on which the bobbin in formation is resting. The yarn is spirally wound onto the bobbin in formation as the collection unit is provided with a thread-guide device which distributes the yarn with a backward and forward axial movement onto the outer surface of the bobbin.

The structure of the individual spinning station is illustrated in the scheme of FIG. 1, and its functioning is briefly described hereunder according to its normal operating mode.

Proceeding upwards, the single spinning station 1 consists of an actual spinning unit 2 and a collection unit 3, of which the main components which lead to the transformation of the sliver of parallelized fibres to the bobbin of wound yarn are briefly illustrated below.

The feeding tape or sliver S is contained in a cylindrical vase 4 which it is deposited with a double spiral. The sliver S is fed to the unit by a feeding roll 5 passing through the funnel-shaped conveyor 6 and reaches the card 7, a rotating roll equipped with a toothed washer which singularizes the fibres of the sliver S and sends them by suction to the spinning rotor 8, which operates in depression.

The singularized fibres are deposited by a centrifugal effect in the peripheral throat of the spinning rotor 8, which rotates at very high velocities (up to 150,000 revs/minute and over); from here they are collected and removed in the form of the thread F, axially leaving its central opening 9, receiving torsions by the rotation of the rotor itself in the course which runs between its internal throat and said opening 9, thus creating the twisted thread F.

The capturing of the thread is effected with a pair of opposite extraction cylinders 11 and 12 which seize the thread F and driven at a controlled rate according to the arrow a, thus causing the linear production of yarn, generally indicated in m/min. The quality-control sliver 14 of the yarn F can be positioned before the cylinders 11/12.

The thread F thus produced enters the collection unit 3, passes through a thread-presence sensor 15 and encounters a compensator 16 for compensating the variations in length of the run between the spinning unit 2 and the depositing point of the yarn F on the bobbin. The thread-guide device 21 distributes the thread on the bobbin in formation by transversally moving with a backward and forward movement according to the double arrow b, activated by a motor 20 which drives a longitudinal rod 22 in common with the other units of the spinning machine.

The bobbin 25 collects the thread F and is held by the bobbin-holder 26 equipped with two idle and openable counterpoints 27 which become engaged with the base tube 28 of the bobbin. The bobbin in formation 25 rests on its activation roll or collection cylinder 29.

Recently designed automatic open-end spinning machines are equipped with service trolleys which patrol the fronts of the spinning machine and effect the required interventions by stopping in front of the spinning unit which require them.

There are essentially three types of interventions required:

start-up, at the beginning of the spinning starting from the stopped spinning machine, activating it and subsequently positioning a new tube in each station, the starting being effected with reattachment with an auxiliary thread and winding the thread produced on the new tube to form a bobbin, after eliminating the section of auxiliary thread;

reattachment, when the yarn is interrupted for any reason, without having reached the length established for completing the bobbin, using the yarn already produced from the side of the bobbin, reattaching and restarting the winding on the same bobbin. The reattachment procedure consists, in its essential lines, in the opening, cleaning and closing of the rotor, the preparation of the sliver end, capturing and preparation of the skein-end on the side of the bobbin, restarting of the rotor and feeding, re-introduction of the prepared skein-end in the rotor, re-extraction of the skein-end connected to the newly produced thread by rewinding it in the collection unit. The cleaning cycle programmed is equivalent to the reattachment cycle, caused with a controlled breakage of the thread;

removal, after reaching the length required for completing the bobbin. After stopping the bobbin, a final thread reserve is deposited on the tip of the tube, which allows the skein-end or top of the bobbin yarn to be easily identified and removed, in the subsequent use of the bobbin in operations effected downstream, for example weaving. The present invention is directed in particular to this operation. The finished bobbin is unloaded and the start-up of the unit is then effected as described above, for the production of a new open-end bobbin of yarn.

These interventions are generally effected by separating the bobbin 25 from its activation cylinder 29, stopping its movement and allowing the activation of the bobbin 25 or its tube 28 to be effected by an auxiliary activation roll situated on board the service trolley.

In the field of intervention and devices and procedures of automated service trolleys for open-end spinning machines, the applicant is the holder, among other patents, of the following patents IT 1,146,694, EP 340,863, EP 443,220, EP 473,212, IT 1,258,220, IT 1,258,221, IT 1,258,222, EP 1,524,230 A2.

The automation trolley generally consists of a moveable structure along the fronts of the machine, a communication system with the central control unit of the spinning machine and with the spinning units which form the machine, a translation and stopping system of the trolley in front of the units which require the intervention. The moveable structure carries both its control unit and the specific organs or groups of organs for single or multiple operations of the various cycles, which can be required each time and are managed by said control unit.

The present invention can refer to the service trolleys described and claimed by the same applicant in its European patent application EP 1,524,230 A2, to which reference should be made for its structure and essential components.

SUMMARY OF THE INVENTION

The present invention relates to a device for controlling the positioning and configuration of the thread-run during cycles operated by the service trolley of an open-end spinning machine.

An objective of the present invention is to provide a thread control and positioning device during intervention cycles of the trolley which allows a greater efficiency of the trolley to be obtained and a greater performance of the spinning machine, in addition to an open-end bobbin of yarn which can be easily used in subsequent utilizations.

In order to better illustrate the problems faced and technical solutions proposed with the present invention, reference is therefore made in the following description to a scheme of a trolley in which the device according to the invention is inserted, at the service of an open-end spinning machine, for illustrative and non-limiting purposes, with the specific indication that it can also be advantageously used in a trolley in which the service groups and organs differ in type and arrangement.

BRIEF DESCRIPTION OF THE SEVERAL VIEWS OF THE DRAWINGS

FIG. 7 illustrates the operation of the measuring device according to the invention.

DETAILED DESCRIPTION OF THE INVENTION

Figure 1:
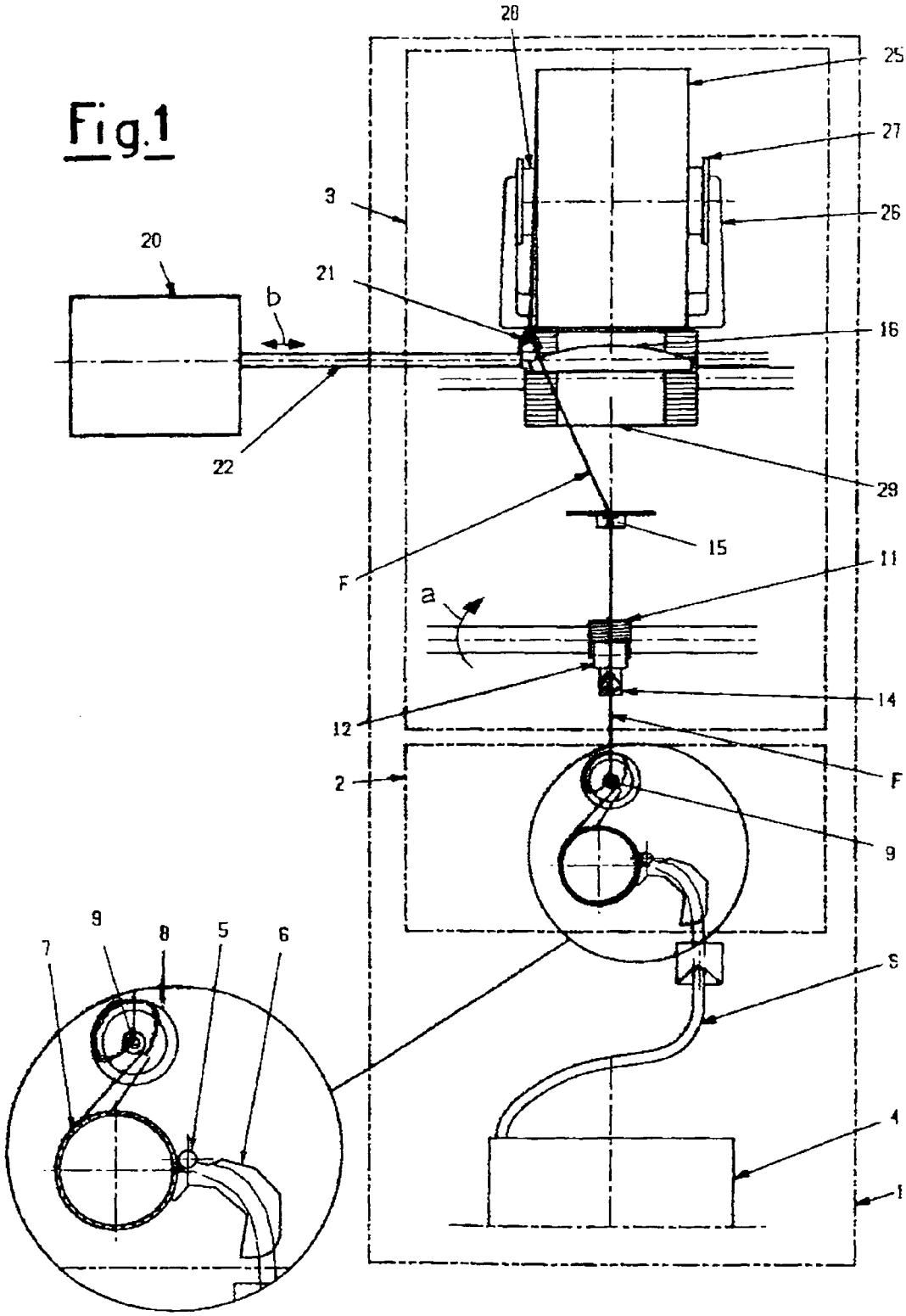
FIG. 1 illustrates the scheme of an open-end spinning unit in its most significant components.
Figure 2:
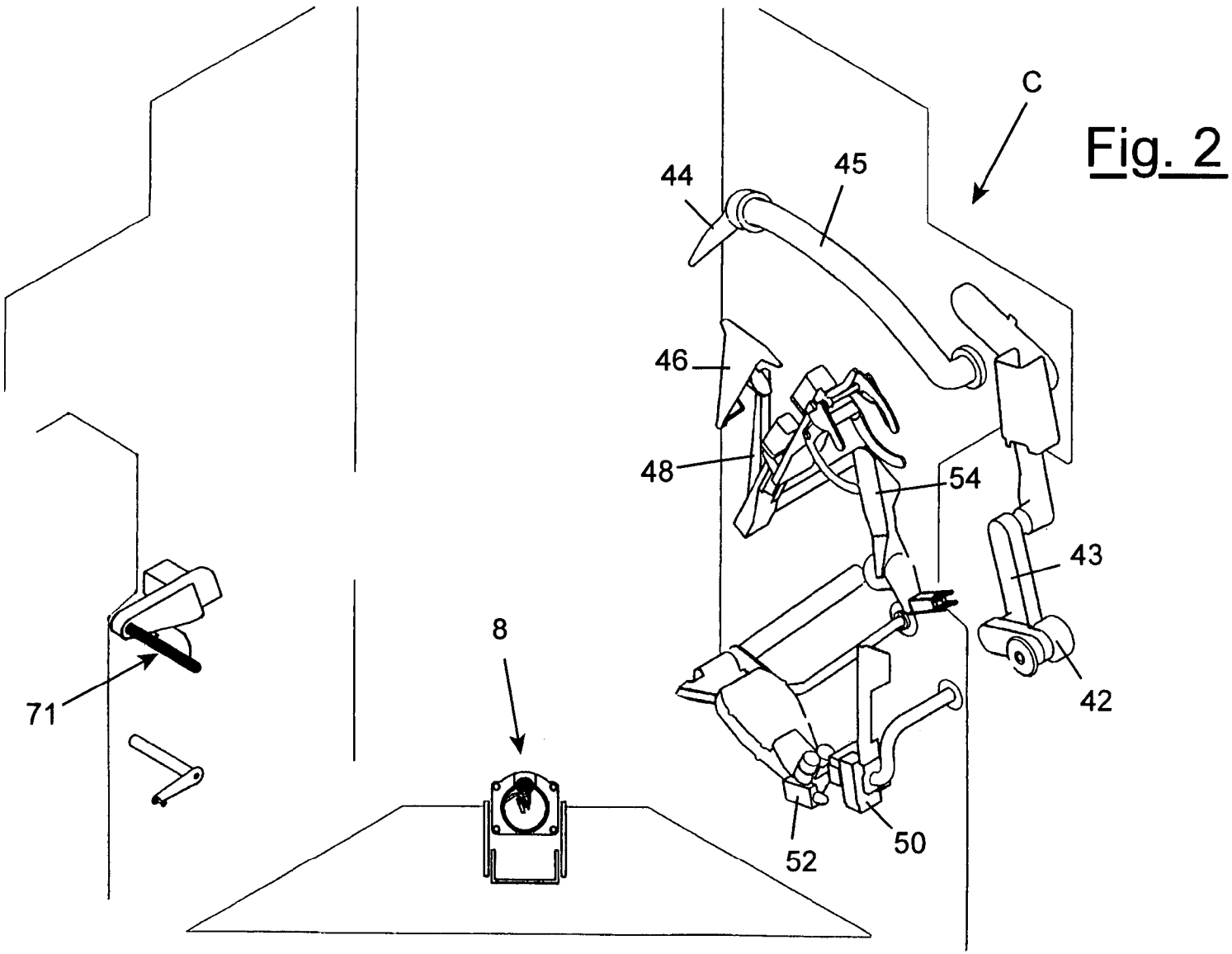
FIG. 2 illustrates a scheme of a trolley C according to the invention of an open-end spinning machine.

FIG. 2 illustrates a scheme of a trolley C at the service of an open-end spinning machine, in which the most significant organs or groups which intervene in the service are indicated, together with the device according to the invention for the control and positioning of the thread and traces the scheme of the previous patent application EP 1,524,230 A2, to which reference should be made for further details.

Figure 3B:
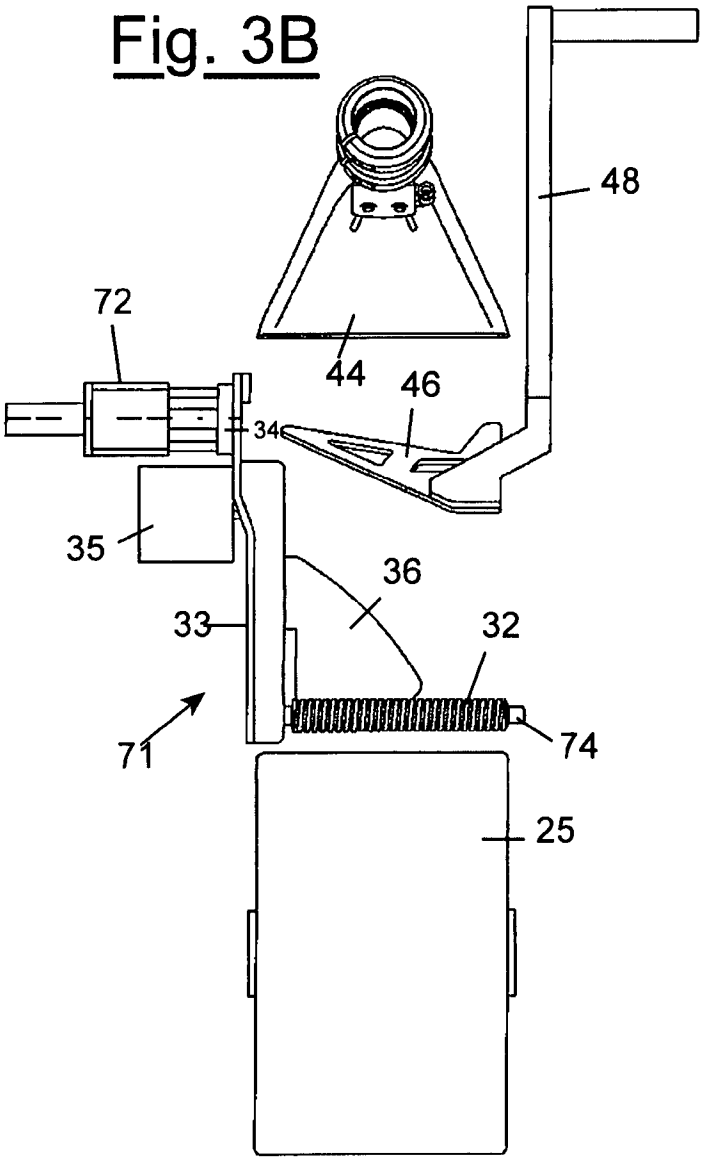
FIG. 3B is a schematic drawing of the measuring device of the invention.
Figure 3A:
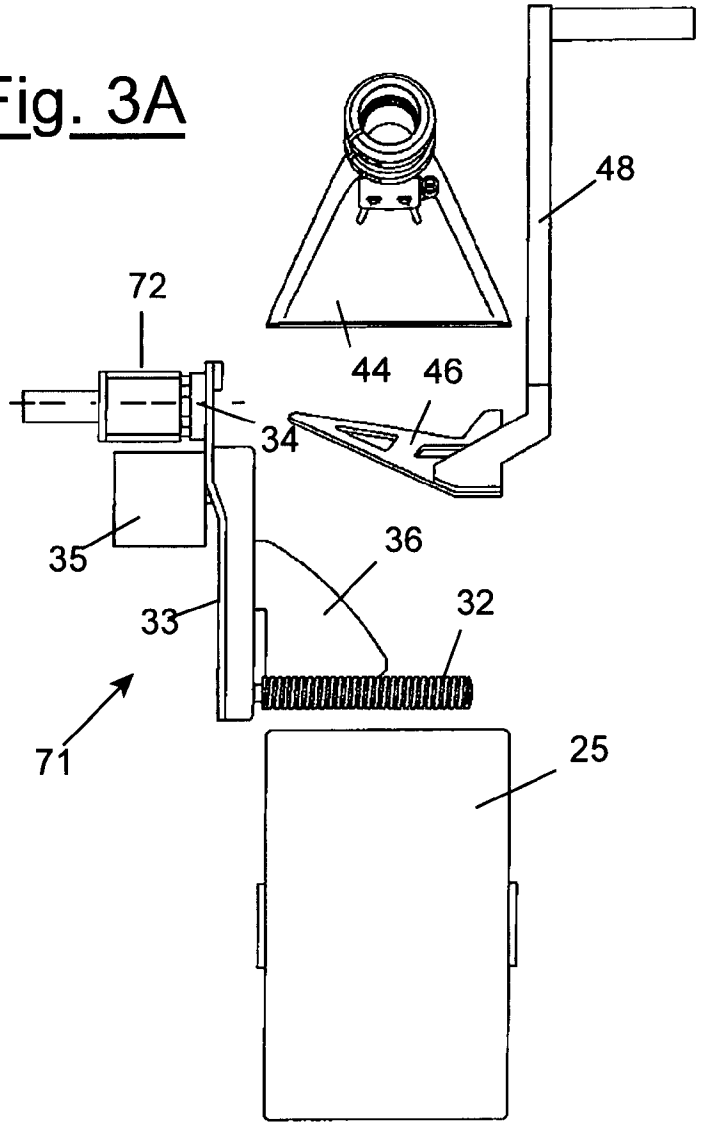
FIG. 3A is a schematic drawing of the measuring device of the invention.

With reference to FIGS. 3A, B, C, these illustrate the structure of the device according to the invention.

FIGS. 4 to 7 show its activation and movement during the depositing phases of the final thread reserve on the completed bobbin.

The device according to the invention is defined, in its essential components, in the first claim whereas its variants and preferred embodiments are specified and defined in the dependent claims.

FIG. 2 shows an exploded view of the internal parallelepiped space of the trolley C, in which its most significant organs or groups for serving the open-end spinning unit with respect to the present invention, are schematically indicated, including the device 71 according to the invention for the control and positioning of the thread, and in particular:

- the device 71 for the control and positioning of the thread F during the intervention cycles which form a particular characteristic of the present invention and is described further on and in greater detail with reference to FIG. 3;
- an auxiliary motorized activating roll 42 in rotation of the bobbin 25 or new tube 28, during service interventions. It can be brought into service or withdrawn with the arm 43;
- a moveable suction mouth 44 for capturing the skeinend of the thread from the side of the bobbin 25, moving towards/away with rotation of its arm 45;
- a V-shaped centralizer device 46 for taking and moving the thread captured by the mouth 44. It is moved with rotation of its arm 48. It is object of patent EP 473,212;
- a preparatory group 50 of the thread skein-end, for its re-introduction into the spinning rotor 8. Greater details concerning its structure and functioning are described in patent EP 443,220;
- an introducer group 52 of the skein-end of the thread F into the spinning rotor 8 for the re-start of the spinning;
- a lifting and opening group 54 of the bobbin-holder arm 26 which disengages the bobbin from its roll 29 at the beginning and releases it at the end of every intervention cycle.

The trolley organs are managed by the control unit of the trolley itself, which in turn communicates with the central control unit of the spinning machine and with the single spinning stations. The control unit of the trolley coordinates the phases of the intervention cycles, gives activation commands to its organs and receives surveys of the relative sensors and run-ends, controlling the complete or incomplete termination of every phase and taking the necessary measures of the case.

FIG. 3 illustrates a typical embodiment of the device 71 according to the invention for the control and positioning of the thread during the interventions of the trolley. The device is illustrated with a view from above in its drawn back (FIG. 3A) and extended (FIG. 3B) positions in action.

The device 71 is installed, —in the view of FIG. 2—to the left of the front of the trolley and consists of a worm screw 32, with a horizontal and parallel axis at the front of the spinning machine, having one of its ends free and the other occupied by a cantilever supporting arm 33. It can be lowered or lifted by rotation of its supporting arm 33 which rotates around an axis 34, also having a horizontal axis and parallel to the front of the spinning machine. An activating motor 35 in clockwise/anti-clockwise rotation of the worm screw 32 is assembled on the supporting arm, whereas the arm 33 is equipped with positioning means for typically adopting three controlled angular positions which create the level of the screw 32 axis: lowered at rest, lifted operating and maximum elevation, according to the necessity of the intervention cycles, rotating around a horizontal axis 34.

For a preferred embodiment of the intervention cycles, already described in the previous patent EP 1,524,230 A2, a diverting plate 36, having the shape of an asymmetrical and concave hut, is fixed on the internal part of the supporting arm 33. The diverting plate 36 is therefore integral with the worm screw 32 and follows it in its operating and rest positions.

In general, the worm screw 32 has a diameter of 15-30 mm with a smooth-edged thread having a pitch of 4-8 mm. Its activation is in controlled clockwise/anticlockwise rotation with a rate in the order of hundreds of revs/min.

The worm screw 32 has a length which is shorter than the length of the bobbin, as it must carry —rotating in one direction—the thread F from the internal part of the arm 33 to form the initial thread reserve by seizing it between the bottom of the tube 28 and the open counterpoint 27 of the bobbin-holder arm, and on the other hand —rotating in the opposite direction—it must be able to carry the thread F to the opposite free end of the screw 32 and let it fall, in an axial coordinate which is definitely within the range of the thread-guide 21, so that the thread F is hooked thereby to its first useful passage.

The activation motor 35 of the screw 32 can be a brushless motor, or a step-by-step motor, driven —in frequency or by steps —by the control unit of the trolley to obtain angular positions, inversion times and controlled rates in the two rotation directions.

The device 71 for the control and positioning of the thread F so far follows the scheme of the thread positioner of the previous patent application EP 1,524,230 A2.

According to the present invention, in order to allow the depositing of the final thread reserve on the tip of the tube of the completed bobbin, the device 71 for the control and positioning of the thread during the operations of the trolley is equipped with an axial movement organ 72 of the whole device 71 so that the free end of the worm screw 32 can be axially moved to correspond with the winding end of the bobbin, i.e. with the tip of the tube 28. The organ 72 is therefore predisposed for two positions: one drawn back (FIG. 3A) for the re-attachment, removal and starting procedures for a new bobbin already described in EP 1,524,230 A2; the other position on the other hand is extended (FIG. 3B) and concerns the depositing operation of the final thread reserve on the tip of the tube of the completed bobbin. The axial movement organ 72 can therefore consist for example of a double-effect pneumatic cylinder, alternatingly fed in one of its two parts with the service fluid for a run equal to the required stroke between the two positions. To clarify the spatial relationship of the device 71 during its interventions for depositing the final thread reserve, the operating positions of the mouth 44 and centralizer 46 during the depositing of the final thread reserve are also indicated.

Figure 3C:
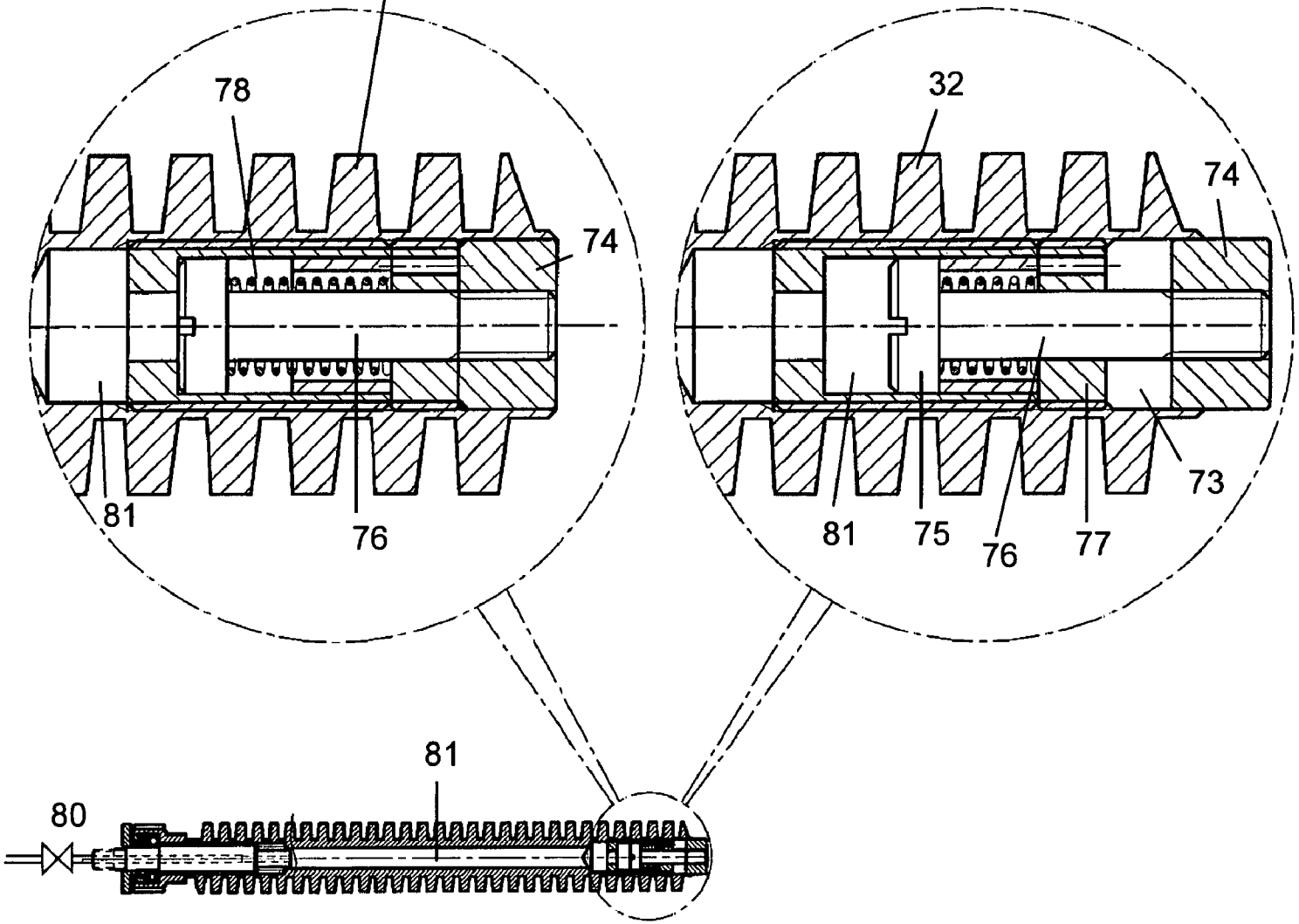
FIG. 3C is a schematic drawing of the measuring device of the invention.
Figure 4B:
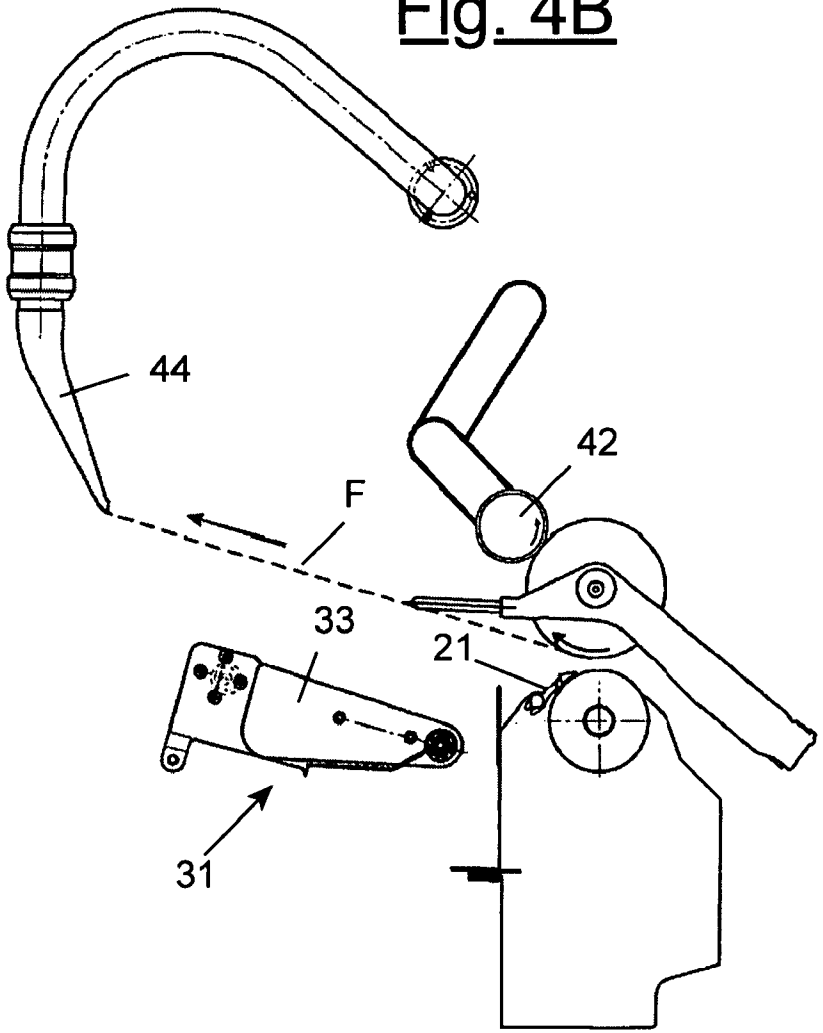
FIG. 4B illustrates the operation of the measuring device according to the invention.
Figure 4A:
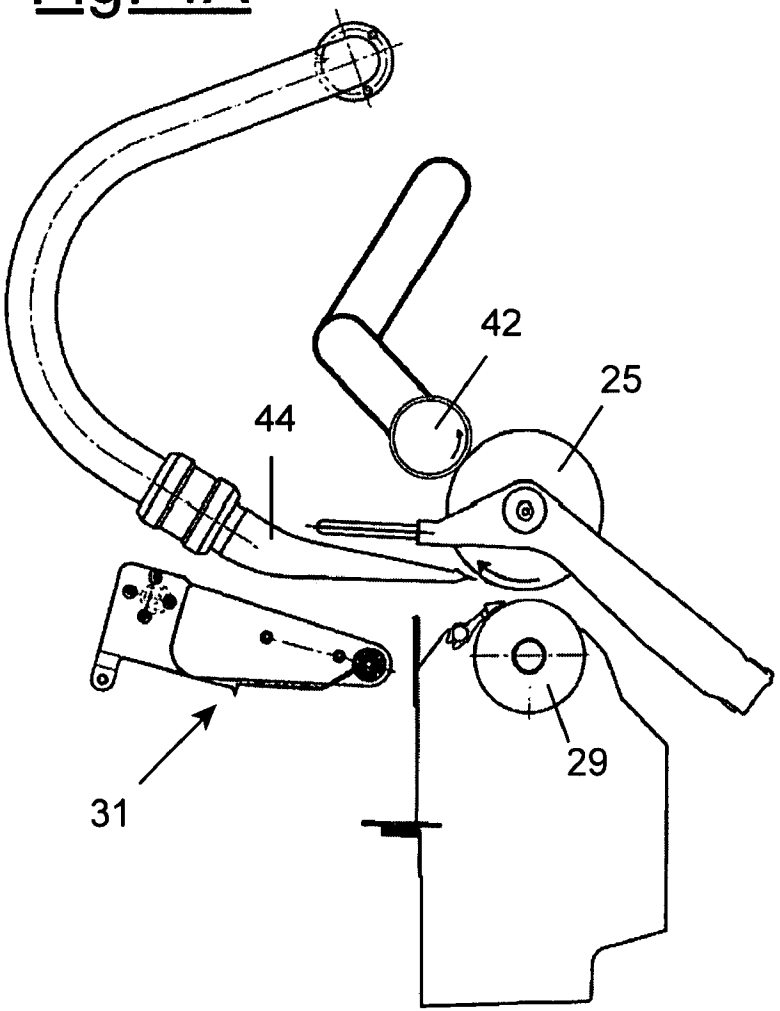
FIG. 4A illustrates the operation of the measuring device according to the invention.

As better illustrated in FIG. 3C, on the free end of the worm screw 32 there is also a cylindrical cavity 73 coaxial with the screw in which an extractable and withdrawable cylindrical plug 74, preferably smooth, is housed. It serves for the depositing operation of the final thread reserve on the tip of the tube of the completed bobbin and for this purpose is extended outwardly, for example by the action of a simple-effect pneumatic piston fed with a service fluid under pressure and contrasted by a spring-back. When the effect of the service fluid has ceased, the plug 74 is left to re-enter its cavity 73.

In the enlarged detail of FIG. 3C, the structure of the worm screw 32 is illustratively shown together with its extension and withdrawal device of the plug 74. In the configuration on the left the plug 74 is withdrawn, whereas in the configuration on the right the plug 74 is extends outwards from its cavity 73.

The cavity 73 is in cylindrical form and the plug 74 is integrally connected to a sliding piston 75 with a bar 76 which slides guided by a hollow guide 77, on which the contrast spring 78 which tends to push the piston 75 to the left, rests. In order to extend the plug 74, a service fluid is fed under pressure, for example compressed air, with an electrovalve 80 which injects said fluid into the axial cavity 81. When the plug must be withdrawn, the electrovalve 80 is commuted and the fluid is discharged. The thrust of the spring 78 prevails and the plug 74 re-enters the cavity 73.

To illustrate the functioning and characteristics of the device 71 for the control and positioning of the thread during the interventions of the trolley in greater detail, the most important steps are described hereunder, of the operation for depositing the final thread reserve onto the tip of the tube of the completed bobbin before being unloaded, with reference to FIGS. 4 to 7, which show the positions adopted by the trolley organs.

With respect to the re-attachment, removal of the completed bobbin and re-start procedures for the new bobbin reference should be made to their description in EP 1,524,230 A2.

As far as the depositing operation of the final thread reserve onto the tip of the tube is concerned, this operation is effected as follows.

In general, when the length limit envisaged for the bobbin 25 has been reached, the spinning is stopped by providing a signal. Analogously to the re-attachment cycle, the peripheral control unit of the unit lifts the bobbin 25 disengaging it from its cylinder 29, causes the bobbin to brake and requests the intervention of the service trolley. The feeding roll 5 of the sliver S at the spinning unit 2 is also stopped.

When the service trolley C is positioned in front of the spinning unit to be served, the control unit starts the intervention cycle coordinating the operations of the various organs involved. Its lifting group 54 additionally lifts the bobbin 25, leaving it idle; analogously to the re-attachment interventions, the auxiliary activation roll 42 in rotation of the bobbin 25 is brought alongside. The moveable suction mouth 44 for capturing the skein-end of the thread from the side of the bobbin 25, is also brought alongside (FIG. 4A) and then withdrawn (FIG. 4B), illustrated already in a withdrawn position with the captured thread F. The combined action of the roll 42, activated in anticlockwise rotation for unravelling the thread F already wound onto the bobbin 25, and suction with the mouth 44 takes the thread F which —in its unwinding —is moved by a traversing movement, i.e. transversal backward and forward movement.

The centralizing device 46 is also activated by lowering it to take the thread F in its gripping fork (FIG. 5A), continuing to release thread with the auxiliary roll 42 and suck thread with the mouth 44 until the necessary length has been reached for generating the final thread reserve, generally 2-4 metres, subsequently stopping the rotation of the auxiliary roll 42.

According to a preferred embodiment of the present invention, the length of the thread reserve is easily determined by controlling —on the part of the control unit of the trolley —the number of revs, for which the auxiliary roll 42 is activated in the unwinding of the bobbin 25.

With the coordination of the control unit of the trolley, the device 71 is first brought to a completely extended configuration by activating the axial movement organ 72 so that the free threaded end of its worm screw 32 is axially moved to correspond with the winding end of the bobbin, and also with its cylindrical plug 74 in an extracted position protruding from the threaded part of the worm screw 32, as indicated in FIG. 3B.

Figure 5B:
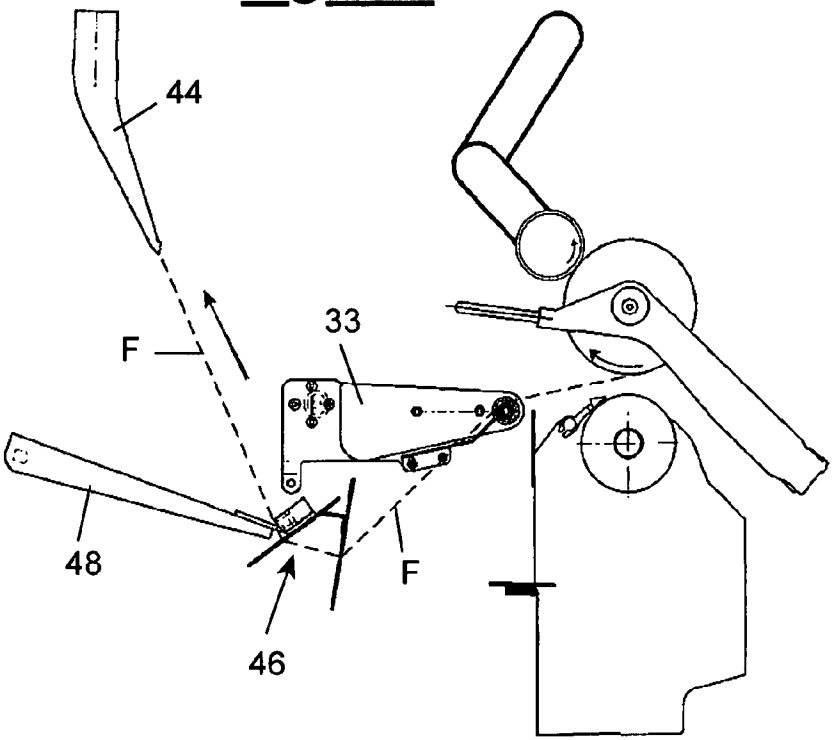
FIG. 5B illustrates the operation of the measuring device according to the invention.
Figure 5A:
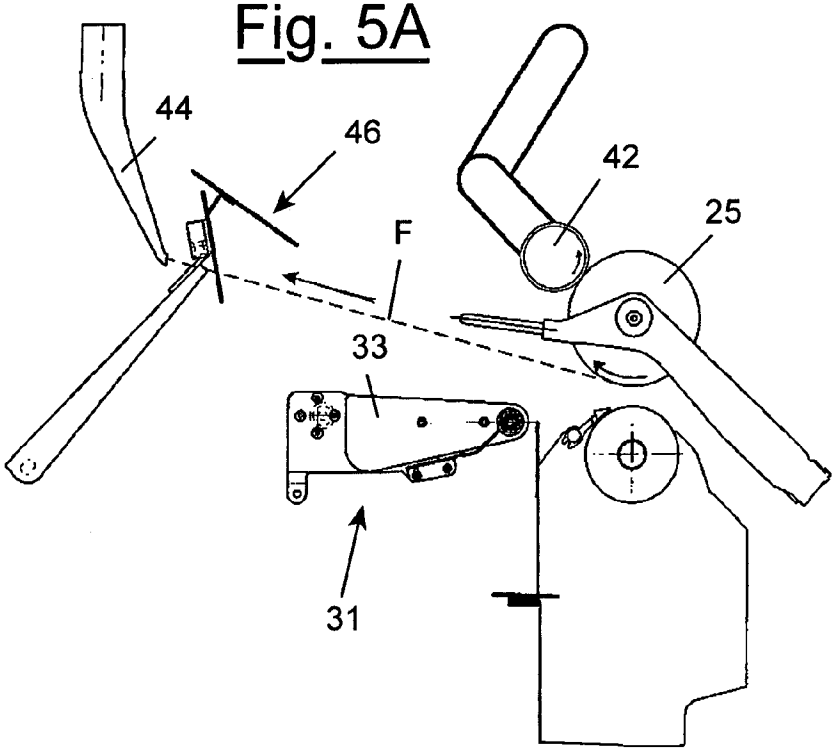
FIG. 5A illustrates the operation of the measuring device according to the invention.

The device 71 is then lifted by rotation of its supporting arm 33 from rest position to the extended position at its maximum height carrying its worm screw 32 adjacent and parallel to the bobbin 25 (FIG. 5A).

When the centralizing device 46 has completed its lowering and lifting of the device 71 has brought its screw 32 to intercept the immobile thread F, which has been unwound from the bobbin 25 to the extent required by the mouth 44, there is the configuration shown in FIG. 5B. The thread F comes from a random point of the surface of the bobbin 25 between its top and base and rests in the cavity of the screw 32 threading —still immobile —brought to the maximum lifting position of the device 71.

Figure 6B:
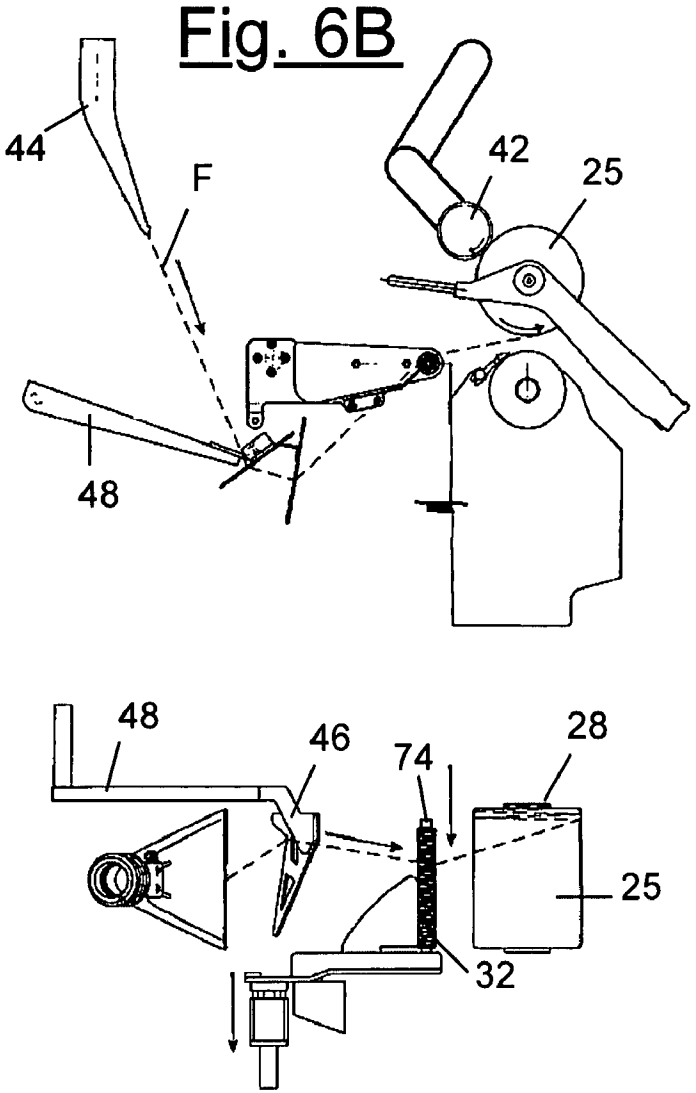
FIG. 6B illustrates the operation of the measuring device according to the invention.
Figure 6A:
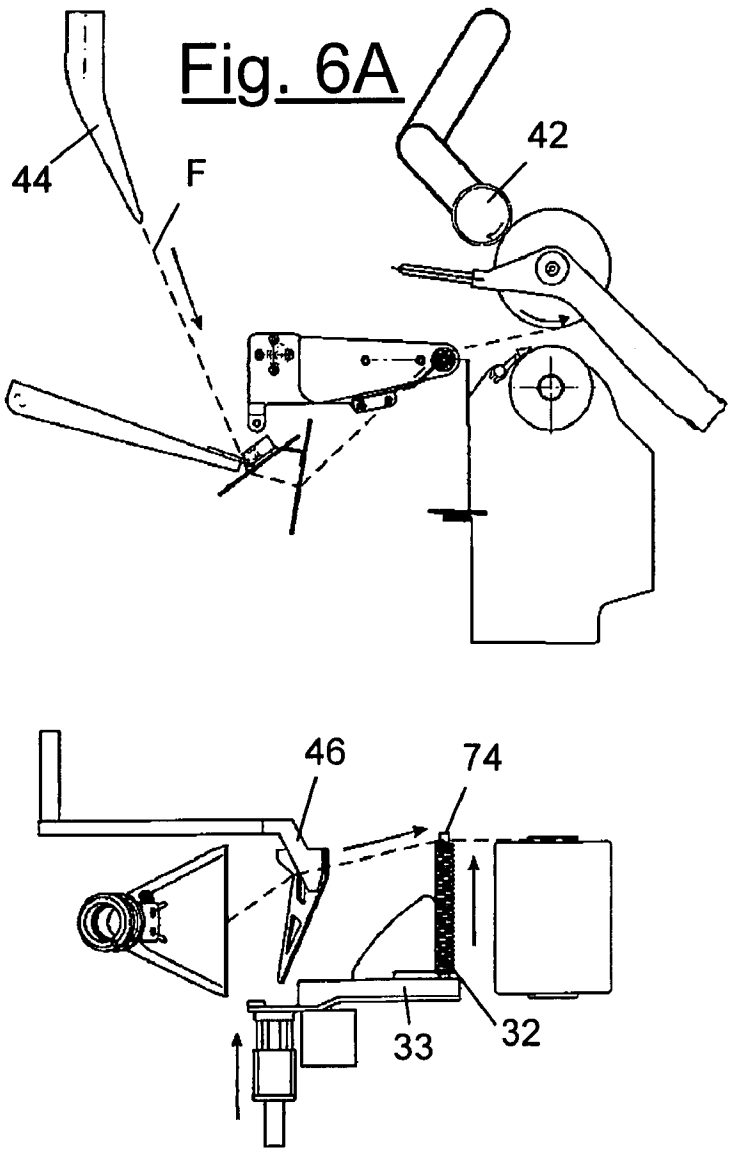
FIG. 6A illustrates the operation of the measuring device according to the invention.

In FIGS. 6A, 6B and 7, the threading station is shown both in a side view and also in a view from above to better illustrate the movement of the thread.

Starting from the configuration of FIG. 5B, the thread F —again sucked with the mouth 44 —has a sufficient winding angle as the thread of the screw 32, in clockwise rotation, forces the thread to follow it towards the left, as far as the free end of the worm screw 32 and fall onto the smooth surface of the extracted plug 74, remaining in the configuration of FIG. 6A. Coherently with the rotational starting of the worm screw 32, the auxiliary roll 42 is activated to rewind the thread onto the bobbin 25 in clockwise rotation to recover the thread F sucked into the mouth 44 in the previous phase. The thread F is spirally rewound onto the bobbin 25 until it falls onto the tip of its tube (FIG. 6A).

According to a preferred embodiment of the present invention, the worm screw 32 is activated at a high velocity so that the rewinding spiral is extremely tilted. With its falling onto the extracted plug 74, the course of the thread F is diverted between the centralizer 46 and the tip of the tube 28, as it is resting on the extracted plug 74. The rotation of the worm screw 32 is stopped, the thread F runs on the smooth surface of the plug 74, with the same axial coordinate: the roll 42 continues to be activated for winding and winds the thread F with clockwise rotation for one or more turns on the tip of the tube to create an identification and attachment point for the skein-end of the bobbin, still recovering the thread from the mouth 44.

According to a preferred embodiment of the present invention, the inversion time of the movement of the worm screw 32 is determined by the control unit of the trolley so as to determine the number of turns of the final reserve thread deposited on the tip of the tube.

After winding the thread F onto the tip of the tube, the winding rotation of the bobbin is continued, whereas the worm screw 32 is restarted, but in an anticlockwise rotation as shown in FIG. 6B. The thread of the screw 32 in rotation meets the thread F again and recatches it forcing it to follow it towards the right winding itself on the completed bobbin with a short spiral winding (FIG. 6B), adhering to the surface of the bobbin 25, until exhausting the length of the thread sucked by the mouth 44 (FIG. 7).

The device 71 has therefore terminated the depositing operation of the final thread reserve. It is brought into a withdrawn configuration (FIG. 7) by activating the axial movement piston organ 72 so that the beginning of the worm screw on the internal side of the arm 33 returns to the axial coordinate corresponding to the base of the bobbin 25; its cylindrical plug 74 is also brought back to a withdrawn position in the free end of the worm screw 32. The device 71 is then relowered to rest position.

The bobbin is subsequently unloaded, as already described in EP 1,524,230 A2, by opening the counterpoints 27 of the bobbin-holder arm 26 freeing the completed bobbin 25, bringing the arm 43 to its maximum extension to guide the auxiliary activation roll 42 against the finished bobbin 25, to unload it by pushing it towards the middle between the fronts of the spinning machine where a conveyor belt is positioned.

The control and positioning device 71 according to the present invention exerts all the axial positioning functions of the thread within the range of intervention cycles of the service trolley of an open-end spinning machine, including the depositing of a final thread reserve onto the bobbin facilitating its subsequent use.

The device is capable of acting in different ways: it has the possibility of transporting the thread in an axial direction depending on its configurations and positions, with the effective control of its axial coordinate. During intervention cycles, the device 71 preserves the thread from the to-and-fro strokes of the thread-guide and also controls its level. In service cycles there is no concentrated winding of the thread, but the thread is always axially distributed on the generatrix of the bobbin in formation, avoiding accumulations and entanglement.

The invention claimed is:

1. A device (71) for the control and positioning of the thread (F) for automatic service trolleys for spinning units of open-end spinning machines to effect intervention cycles for start-up, re-attachment of the thread, depositing of the final thread reserve and removal of the bobbins onto the single spinning units, said trolley carrying on board organs or groups of organs destined for single or multiple operations of said cycles, said device (71) comprising a worm screw, with a horizontal axis and parallel to the front of the spinning machine, equipped with a cantilever supporting arm which allows it to be lowered and lifted maintaining the worm screw horizontal and parallel to the front of the spinning machine and in certain positions, and activated in controlled clockwise/anticlockwise rotation driven by a motor, thus determining both the level and the axial coordinate to which the thread is brought, the thread itself being engaged inside the cavity of the threading of the worm screw, which by rotating determines its axial coordinate, characterized in that the device (71) is equipped with an axial movement organ (72) of the whole device (71) so that its worm screw (32) can be axially and alternatingly moved into a withdrawn position so that the beginning of the worm screw on the internal side of the arm (33) coincides with the axial coordinate corresponding to the base of the bobbin (25), or into an extended position so that the free threaded end of the worm screw (32) coincides with the axial coordinate of the winding end of the bobbin (25) on the tip of the tube (28); and in that on the free end of the worm screw (32) there is a cylindrical cavity (73) coaxial with the screw in which an extractable and withdrawable cylindrical plug (74) is housed.

2. The automatic service trolley for spinning units of open-end spinning machines according to claim 1, characterized in that the axial movement organ (72) consists of a double-effect pneumatic cylinder, alternatingly fed in one of its two parts with the service fluid for a run equal to the required stroke between two positions.

3. The automatic service trolley for spinning units of open-end spinning machines according to claim 1, characterized in that activation organ in extension and withdrawal of the plug (74) consists of a simple-effect pneumatic piston fed with a service fluid under pressure and contrasted by a spring-back.

4. The automatic service trolley for spinning units of open-end spinning machines according to claim 1, characterized in that the control unit of the trolley is equipped with control means of the length of the thread reserve captured by the suction mouth (44) determining the number of turns, for which the auxiliary roll (42) is activated for the unwinding of the bobbin (25).

5. The automatic service trolley for spinning units of open-end spinning machines according to claim 1, characterized in that the control unit of the trolley is equipped with control means of the inversion time of the movement of the worm screw (32) in order to determine the number of turns of the final reserve thread deposited onto the tip of the tube.

6. The automatic service trolley for spinning units of open-end spinning machines according to claim 1, characterized in that the device (71) is equipped with activation in rotation of the screw (32) with a brushless motor (35) driven in frequency by the control unit of the trolley to obtain angular positions, inversion times and controlled rates in the two rotation directions.

7. The automatic service trolley for spinning units of open-end spinning machines according to claim 1, characterized in that the device (71) is equipped with activation in rotation of the screw (32) with a step-by-step motor (35) driven in steps by the control unit of the trolley, again obtaining angular positions, inversion times and controlled rates in the two rotation directions.

* * * * *

UNITED STATES PATENT AND TRADEMARK OFFICE

CERTIFICATE OF CORRECTION

PATENT NO. : 7,424,799 B2
APPLICATION NO. : 11/646040
DATED : September 16, 2008
INVENTOR(S) : Roberto Badiali, Vittorio Colussi and Donato Castellarin It is certified that error appears in the above-identified patent and that said Letters Patent is hereby corrected as shown below:

On the Title Page Item (73) Assignee Name should read: "Savio Macchine Tessili S.p.A."

Signed and Sealed this

Second Day of June, 2009

JOHN DOLL
*Acting Director of the United States Patent and Trademark Office*